US006271494B1

(12) United States Patent
Dienemann et al.

(10) Patent No.: US 6,271,494 B1
(45) Date of Patent: Aug. 7, 2001

(54) HIGH VOLTAGE CIRCUIT BREAKER WITH TWO ARCING CONTACTS WHICH CAN BE ACTUATED IN AN OPPOSITE DIRECTION

(75) Inventors: Hold Dienemann, Berlin; Volker Lehmann, Treuenbrietzen; Heiner Marin, Berlin, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/446,778

(22) PCT Filed: Jun. 26, 1998

(86) PCT No.: PCT/DE98/01822

§ 371 Date: Jun. 23, 2000

§ 102(e) Date: Jun. 23, 2000

(87) PCT Pub. No.: WO99/00814

PCT Pub. Date: Jan. 7, 1999

(30) Foreign Application Priority Data

Jun. 26, 1997 (DE) ..... 197 27 850

(51) Int. Cl.[7] ..... H01H 33/04; H01H 9/30

(52) U.S. Cl. ..... 218/84; 218/48; 218/78

(58) Field of Search ..... 218/48, 49, 50, 218/53, 65, 78, 84, 43

(56) References Cited

U.S. PATENT DOCUMENTS 4,973,806 * 11/1990 Kirchesch et al. ..... 218/84
5,578,806 * 11/1996 Hofbauer et al. ..... 218/59

FOREIGN PATENT DOCUMENTS 479 155 9/1969 (CH) .
0 313 813 5/1989 (EP) .
0 696 040 2/1996 (EP) .
2 491 675 4/1982 (FR) .
WO 98/32142 7/1998 (WO) .

* cited by examiner

*Primary Examiner*—Ramon M. Barrera
(74) *Attorney, Agent, or Firm*—Kenyon & Kenyon

(57) ABSTRACT

A high-voltage circuit breaker is described having arcing contacts, which can be driven in opposite directions, as well as corner gears that are coupled, via a driving rod, with the driven insulating nozzle surrounding the arcing contacts, with the corner gears being designed as a lever mechanism using a two-armed control lever. The one end of the control lever is shaped like a fork, with a journal that is attached to the driving rod engaging with this end. The other end of the control lever is coupled, via a reciprocating element, with the head piece of the second arcing contact, which is driven in the opposite direction.

4 Claims, 3 Drawing Sheets

HIGH VOLTAGE CIRCUIT BREAKER WITH TWO ARCING CONTACTS WHICH CAN BE ACTUATED IN AN OPPOSITE DIRECTION

FIELD OF THE INVENTION

The present invention relates to high-voltage circuit breakers and provides the structural design of the drive mechanism that moves the auxiliary contacts, used for arc quenching, in opposite directions.

BACKGROUND INFORMATION

In circuit breakers, the two coaxially opposite auxiliary contacts, frequently referred to as arcing contacts, are coaxially surrounded by two permanent-current contacts, one of which is stationary and the other designed to move in an axial direction. Circuit breakers of this type usually work with a gaseous quenching agent that flows through the area separating the contacts during switching and whose flow can be influenced by special compression chambers and nozzles. Among other things, an insulating nozzle that is located within the permanent-current contacts, surrounds the arcing contacts, and can be permanently connected to both the drivable permanent-current contact and the driven arcing contact, is used for this purpose.

In a conventional circuit breaker of this type, as described in, for example, European Patent No. 0 313 813, a driving element is attached to the insulating nozzle, which transmits the driving movement of the driven permanent-current contact to the second arcing contact via corner gears in such a way that the two arcing contacts are driven in opposite directions. For this purpose, the second arcing contact is inserted into a sliding contact. In the known corner gears, the driving element is designed as a gear rack that acts upon the second arcing contact, which is also designed as a gear rack, via a gear wheel. The driving movement of the insulating nozzle is transmitted linearly onto the second arcing contact being driven in the opposite direction. Alternatively, the corner gears can also be a locking mechanism having a ratchet gear that is moved by the driven contacts and a clamping part equipped with a compression spring, with the clamping part driving the arcing contact moving in the opposite direction in a pulsating manner after a ratchet clears the ratchet gear.

In another conventional circuit breaker of this type, a crank can also be used as the corner gear, with its rotating part being formed by the gear wheel that is driven by the gear rack connected to the insulating nozzle, as described in, for example, European Patent No. 0 696 040. The linear movement of the gear rack is transmitted sinusoidally to the second arcing contact.

In conventional corner gears, the second arcing contact driven in the opposite direction is coupled with the complete travel of the first driven arcing contact either permanently or only temporarily using a low-precision ratchet gear.

SUMMARY

An object of the present invention is to design the corner gears so that, when the first driving arcing contact engages positively with the second arcing contact driven in the opposite direction, the second arcing contact is driven only along part of the contact travel, allowing the second arcing contact driven in the opposite direction to pass a defined maximum speed at a predetermined point during this driving phase.

According to the present invention, this object is achieved by designing the rod-like driving element as a coupling rod having a journal positioned transversely to the direction of thrust, and providing the corner gears with a two-arm control lever having two stable end positions, with one of its two ends being designed in the shape of a fork for connecting-link type guidance of the journal, and the other end being pivoted on the second arcing contact via a reciprocating element. This reciprocating element can be a connecting rod or a journal that engages with a slot in the second arcing contact.

A corner gear embodiment of this type is characterized by fewer, simpler, and lighter-weight components so that the corner gears have a low mass and form a self-contained unit that can have a flat design, therefore not hindering the flow of insulating gas (waste gas) that is produced in the stationary permanent-current contact during switching. The corner gears also have a transmission ratio that varies during actuation, is designed in the form of a sinusoidal half wave and its maximum can exceed 1:1, i.e., the second arcing contact being driven in the opposite direction can be moved at a higher speed than the first arcing contact during the decisive phase of contact opening (phase of contact separation and increasing distance between contacts). To achieve this, the corner gears are suitably designed so that the coupling rod is inserted into a guideway fastened to the stationary permanent-current contact. The fulcrum of the two-armed control lever is located between the thrust connecting rod and the axis of the second arcing contact and is also connected to the stationary permanent-current contact. The two-armed control lever is also positioned at an angle to the thrust rod and to the axis of the second arcing contact when in its stable end positions. The fork-shaped end of the control lever is additionally provided with a longitudinal, open-ended cut-out between the two tines. The further journal located on the other end of the control lever is also positioned transversely to the direction of coupling rod travel, with the slot with which this journal engages being located in a head piece provided on the second arcing contact. The head piece, in turn, is guided in an axial direction along with the stationary portion of the journal bearing connected to the sliding contact. The fork-like design of the one end of the control lever can provide an open-ended cut-out that is designed so that the inward and outward axial movement into and out of the second arcing contact takes place without impact. To ensure secure guiding of the control lever in its three positions (open, moving, and closed) in a compact design, the thrust rod, according to a further embodiment of the present invention, has a guideway that is provided with a cut-out that clears the rotational range of the fork-shaped end of the control lever, and the two tines of the forkshaped end of the control lever are provided with flattened areas on their outer surfaces, allowing the control lever to rest against the bottom of the thrust rod when the control lever is in either of the two end positions. To stabilize these two end positions, two stops are also attached to the stationary portion of the journal bearing, with one of the flattened areas on the control lever coming to rest against these stops. This prevents control lever overshooting at the end of the engagement between the journal and the fork-shaped end of the control lever.

DETAILED DESCRIPTION

Figure 1:
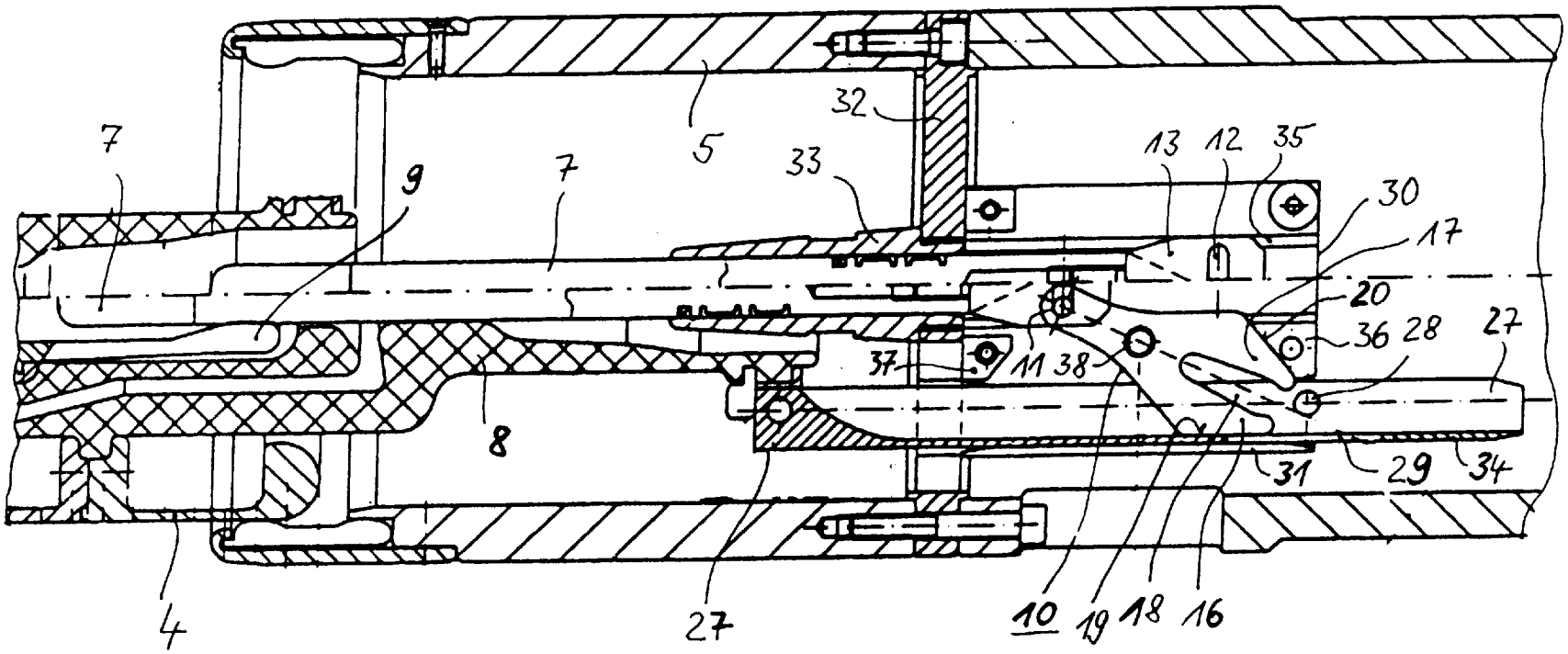
FIG. 1 shows the assignment between the corner gears and the stationary permanent-current contact of the high-voltage circuit breaker in one end position, according to an example embodiment of the present invention.
Figure 2:
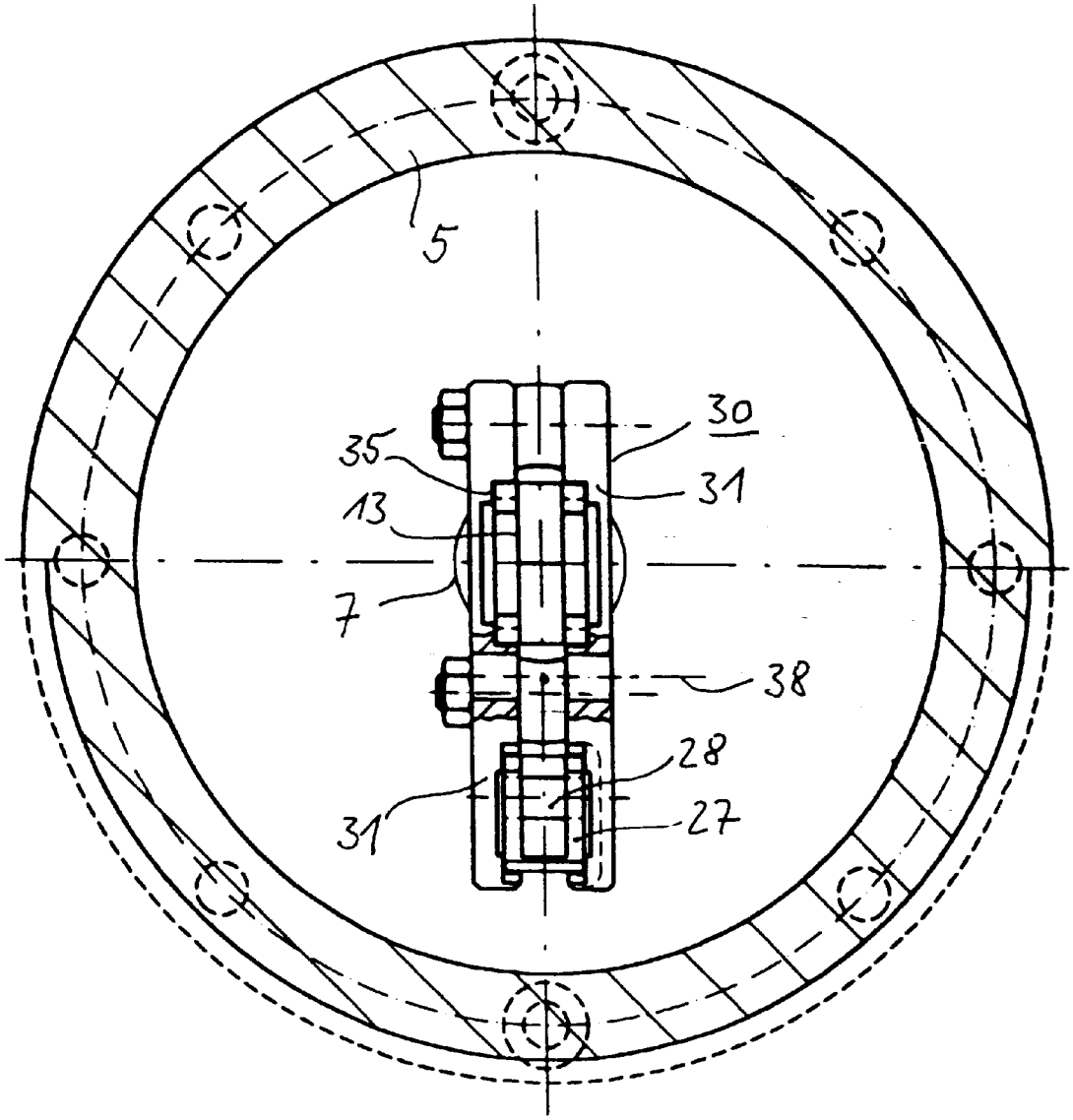
FIG. 2 shows a cross-section of the corner gear arrangement according to the present invention.

Based on FIG. 2 of European Patent No. 0 313 813, FIG. 1 shows a section of stationary permanent-current contact 5 of a high-voltage circuit breaker into which projects axially driven permanent-current contact 4, with insulating nozzle 8 attached to it, and first axially driven arcing contact 9. The lower half of FIG. 1 shows the closed position of drivable permanent-current contact 4, while the upper half shows the open position of insulating nozzle 8. In the closed position, insulating nozzle 8 also surrounds second arcing contact 7 being driven in the opposite direction. Rod-type driving element 27 is attached to insulating nozzle 8, with driving element 27 being designed in this case as a coupling rod rather than a gear rack and having a journal 28 for driving corner gears that is located transversely to the travel direction of coupling rod 27, which has a U-shaped cross-section. The coupling rod can also have an L- or T-shaped cross-section, with each cross-sectional part forming one guideway for guiding the coupling rod. In the embodiment, bottom 34 of the U-shaped cross-section forms the guideway.

Unlike the conventional designs, coupling rod 27 shown in FIG. 2 is inserted into two bearing walls 31 which form part of a housing 30. This housing is attached to a contact bridge 32, which is connected to stationary permanent-current contact 5 and carries stationary portion 33 of a tubular sliding contact, in which second arcing contact 7 driven in the opposite direction is contacted via contact plates. The end of second arcing contact 7 facing away from the arcing contact gap is provided with a flat head piece 13 that is inserted into two guideways 35 formed by bearing walls 31 of housing 30. Flat head piece 13 is provided with a slot 12 positioned vertically to coupling rod 27.

A two-armed control lever 10, one end of which is shaped like a fork and the other end is provided with a journal 11, is located in housing 30 on an axis 28 positioned vertically to the plane of the drawing. Journal 11 engages with slot 12 in head piece 13. The forked end has two tines 16 and 17 that surround an open-ended orifice 18 with which journal 28 of coupling rod 27 can engage. On the outside both tines 16 and 17 are provided with a seating surface 19 and 20, respectively, with which control lever 10, depending on its position can rest against bottom 24 of the U-shaped cross-sectional profile of coupling rod 27. Stops 36 and 37 in housing 30 ensure that control lever 10 remains in the correct rest position. Both rest positions represent end positions between which control lever 10 moves under the influence of journal 28. To enable the fork-shaped end to rotate around axis 38, coupling rod 27 must be provided with a longitudinal slot 29 in bottom 24 of the U-shaped cross-section.

Figure 3:
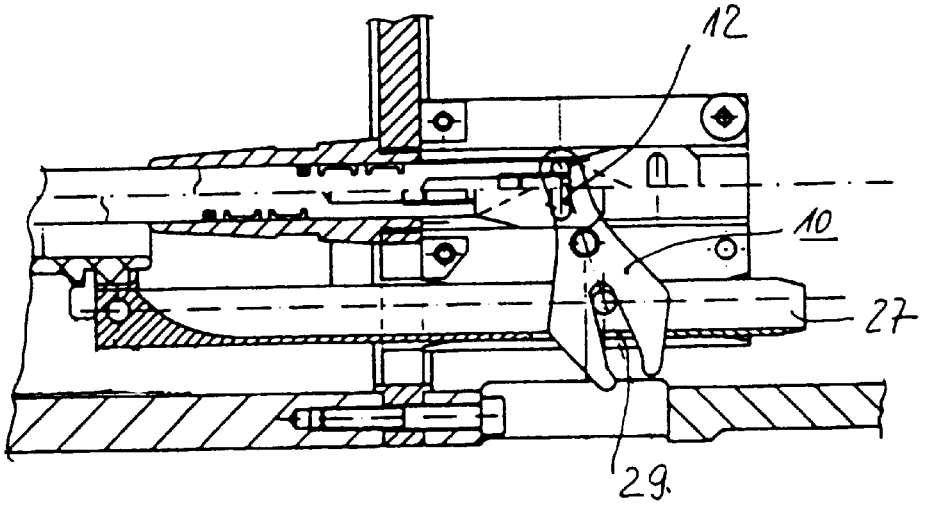
FIGS. 3 to 5 show the corner gears in two intermediate positions and the other end position of the control lever.
Figure 4:
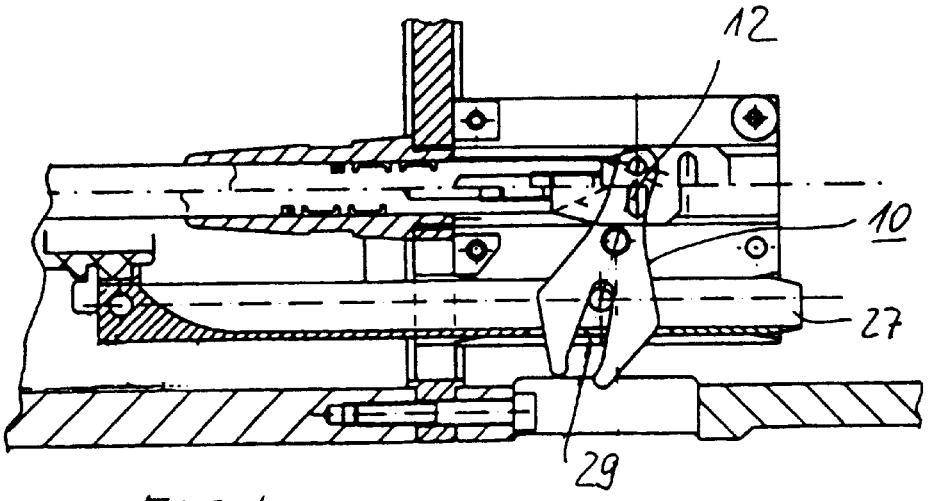
Figure 5:
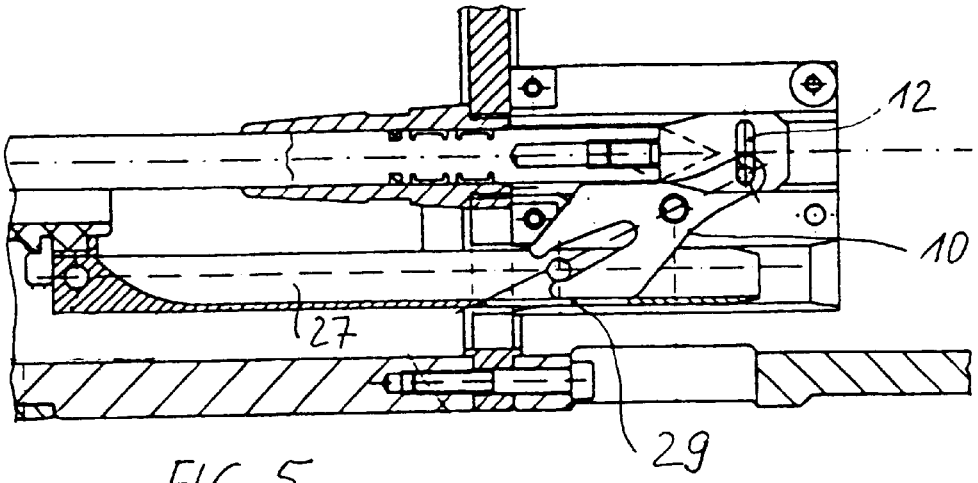

When a tripping movement is performed, coupling rod 27, and thus journal 28, passes continuously through different intermediate positions, starting from the position illustrated in FIG. 1, with FIGS. 2 and 3 showing those intermediate positions that head piece 13—and thus corresponding arcing contact 7 moving in the opposite direction—assumes shortly before and shortly after reaching the maximum speed, while FIG. 5 shows the other end position of control lever 10. Following the position shown in FIG. 5, the coupling rod can move back to the left, without control lever 10 having to change its position.

What is claimed is:

1. A high-voltage circuit breaker, comprising:

a first axially drivable permanent-current contact;

a second stationary permanent-current contact;

first and second arcing contacts axially surrounded by the first and second permanent-current contacts, the first and second arcing contacts positioned coaxially and opposite with respect to one another;

an insulating nozzle permanently connected to both the first permanent-current contact and the first arcing contact;

a sliding contact guiding the second arcing contact;

a reciprocating element;

corner gears including a two-armed control lever having two stable end positions, a first end of the control lever being shaped like a fork, a second end of the control lever being pivoted on the second arcing contact via the reciprocating element; and a rod-type driving element attached to the insulating nozzle and positioned parallel of the second arcing contact using the corner gears, a driving movement of the first permanent-current contact for driving the first and second arcing contacts in opposite directions being transmitted to the second arcing contact via the driving element, the driving element including a coupling rod having a journal positioned transversely to a direction of travel of the coupling rod, the first end of the control lever providing connecting-link type guidance of the journal.

2. The high-voltage circuit breaker according to claim 1, wherein the reciprocating element includes a further journal at the second end of the control lever, and wherein the second arcing contact has a slot with which the further journal engages.

3. The high-voltage circuit breaker according to claim 1, wherein the second permanent-current contact includes a guideway, the coupling rod being guided on the guideway;

wherein a fulcrum of the control lever is located between the coupling rod and an axis of the second arcing contact, the fulcrum being permanently connected to the second permanent-current contact;

wherein the control lever is positioned at an angle to the coupling rod and the axis of the second arcing contact when the control lever is in one of the stable end positions;

wherein the first end of the control lever has a longitudinal, open-ended cutout between two tines; and wherein a further journal is positioned transversely to the direction of travel of the coupling rod.

4. The high-voltage circuit breaker according to claim 1, wherein the coupling rod has a guideway that is provided with an orifice for clearing a rotation range of the first end of the control lever; and wherein two tines of the first end of the control lever include flattened areas on an outer surface which allow the control lever to rest against the guideway of the coupling rod when the control lever is in either of the two end positions.

* * * * *